United States Patent [19]

Khan et al.

[11] Patent Number: 5,072,701

[45] Date of Patent: Dec. 17, 1991

[54] APPARATUS FOR AUTOMATICALLY STARTING ENGINES

[76] Inventors: Rakib Khan; Arif Khan, both of 2850 W. Berwyn Ave., Chicago, Ill. 60625

[21] Appl. No.: 238,118

[22] Filed: Aug. 30, 1988

Related U.S. Application Data

[63] Continuation-in-part of Ser. No. 63,922, Jun. 19, 1987, abandoned.

[51] Int. Cl.[5] ..... F02N 17/00

[52] U.S. Cl. ..... 123/142.5 E; 123/179.5; 123/179.6

[58] Field of Search ..... 123/142.5 R, 142.5 E, 123/179 B, 179 BG, 179 G; 290/38 R, 38 E

[56] References Cited

U.S. PATENT DOCUMENTS

| | | | |
|---|---|---|---|
| 1,287,266 | 12/1918 | Eberly | 123/142.5 R |
| 1,293,569 | 2/1919 | Stein | 123/142.5 R |
| 2,691,110 | 10/1954 | Lincoln | 123/179 BG |
| 3,154,689 | 10/1964 | Bubbenmoyer | 123/179 BG |
| 3,172,400 | 3/1965 | Hale | 123/179 BG |
| 4,188,931 | 2/1980 | Waterhouse | 123/179 BG |
| 4,200,080 | 4/1980 | Cook et al. | 123/179 BG |
| 4,345,554 | 8/1982 | Hildreth et al. | 123/179 BG |
| 4,392,059 | 7/1983 | Nespor | 123/179 BG |
| 4,413,595 | 11/1983 | Potts, Jr. | 123/142.5 R |
| 4,421,075 | 12/1983 | Mandel | 123/142.5 R |
| 4,453,506 | 6/1984 | Ueda et al. | 123/179 BG |
| 4,606,307 | 8/1986 | Cook | 123/179 B |

*Primary Examiner*—Willis R. Wolfe

[57] ABSTRACT

Apparatus for automatically controlling the ready-to-drive condition while maintaining ready-to-start temperature of a single or multiple gas, gas-diesel or diesel engine in automobile uses a electronic circuit linked to various sensors including a temperature sensor, a vibration sensor, and a motion sensor. Signals generated by the temperature sensor are used for auto-reset and to turn the engine on and off based on predetermined maximum and minimum temperature. For multiple engines, sensor can be used to actuate a secondary engine if the primary engine reaches a predetermined maximum temperature and switch back to the primary engine when the engine temperature drops to a predetermined low temperature. For multiple engines, the vibration sensor output determines when control is switched from the primary engine to the secondary engine or vice versa, and also determines the engine cranking time for both multiple and single engines. Signal generated by the motion sensor are used to disable engine activity when accidental motion is detected of the automobile. Control means are provided for regulating several attempts at automatically starting the engine of an automobile with the engine parameters being changed each time. The starting mechanism is reset when the engine starts, and is disabled temporarily if a predetermined number of failed attempts to start have been made. Provision is also made for restarting the engine if stops running and if predefined motor conditions exist.

11 Claims, 4 Drawing Sheets

APPARATUS FOR AUTOMATICALLY STARTING ENGINES

BACKGROUND OF THE INVENTION

This is a continuation-in-part of U.S patent application Ser. No. 063,922 filed Jun. 19, 1987, now abandoned.

This invention generally relates to apparatus for automatically starting engines. In particular, the invention relates to means for starting single or multiple internal combustion engine for automobiles and for maintaining such engines at a ready-.to-start temperature and ready-to-drive conditions.

It is well known that there are many problems related to automatically controlling an engine; cold weather is one of them. Conventional engine starting apparatus generally concentrate only on turning the engine on and off, on the basis of predetermined maximum and minimum temperatures. Existing devices operate mechanically, and use relays, cutouts, switches and other electrical and mechanical components which are not reliable and consume power when the system is not functioning. In addition, these systems use inefficient temperature sensors that operate mechanically or on variable resistance arrangements, and use unreliable oil pressure indications to determine engine condition. Such systems can not analyze engine conditions quickly and consequently make errors in providing the proper response. Also, existing devices are incapable of repeated attempts at starting an engine if it fails to run the first time and instated become disabled and require manual adjustment. These devices also have no control over cranking time after an engine is started, and provide no reliable safety protection regarding engine operations. Furthermore, these systems are complex and difficult to install with engines and cannot be used with multiple engine systems. Conventional devices are also incapable of maintaining a vehicle at a ready-to-start temperature in combination with ready-to-drive conditions.

SUMMARY OF INVENTION

The invention relates to diesel, gas, gas-diesel single or multiple engine. For automobiles with single or multiple engine to maintain ready-to-start condition in combination with ready-to-drive condition, to do this it is required to run the said engine for a certain period of time based on engine temperature and engine condition, or certain desired period of time. For multiple engine in power plant where this invention also can be used to automatically maintain standby said type of engines running by switching control from primary engine to secondary engine or vice-versa. It is well known that the starting parameter of the said type of engine are not always the same. Therefor, it requires different time sequence to actuate the starter as well as changing engine parameters to assure the starting, during or after each trial.

It is an object of the invention to provide improved apparatus for automatically starting and maintaining temperature for gas, gas-diesel, and diesel engines at a ready-to-start temperature.

Another object of this invention is to provide such apparatus for controlling an engine which consumes an extremely small amount of power and yet allows a wide range of engine parameter to be monitored and controlled by making logical decisions based on present and past conditions of the engine.

Another object of this invention is to provide apparatus of the above kind which is capable of a new and most efficiently monitoring engine conditions based on engine temperature, vibration and motion.

A further object of this invention is to provide such apparatus which is capable of multiple attempts at starting an engine while controlling the adjustment of various engine parameters under which each start is attempted.

An important object of this invention is to provide apparatus of the above type which is capable of simultaneously maintaining automobile engine in ready-to-drive conditions while maintaining a ready-to-start temperature conditions.

DESCRIPTION OF THE PREFERRED EMBODIMENTS

Figure 1:
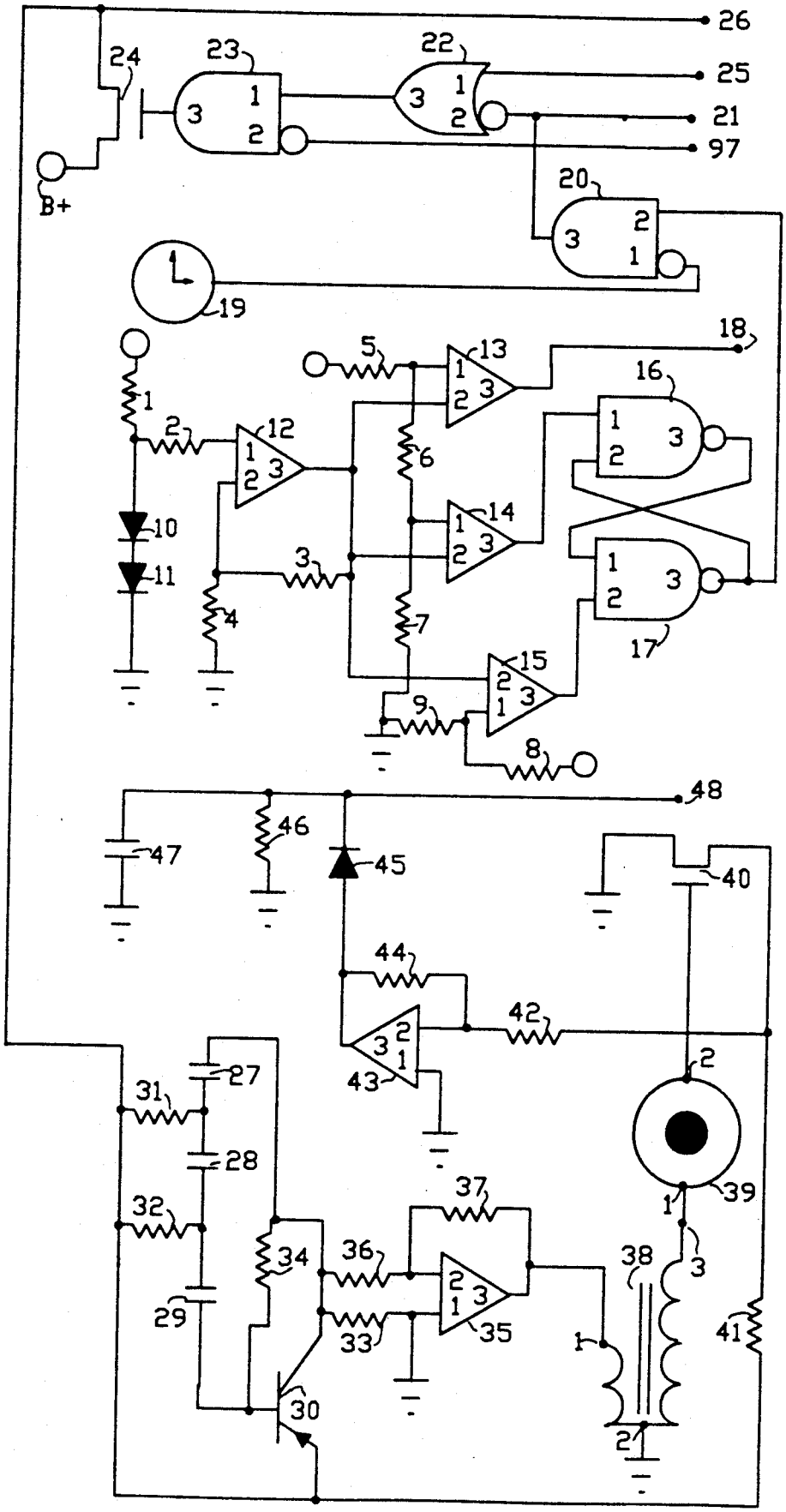
FIG. 1, is a schematic diagram for temperature sensor, motion sensor, also clock bypass for temperature sensor and power supply for most of the components.

Referring to drawing 1, the voltage source B+ is grounded through resistor 1, diodes 10 and 11 are in series. Resistor 2 is connected from resistor 1 to the terminal 1 of amplifier 12. Resistor 3 is connected from terminal 3 to terminal 2 of amplifier 12, also terminal 2 is grounded through resistor 4. Thus, as the engine temperature changes, it causes the diode's threshold voltage to change. These changes are amplified by amplifier 12.

Resistor 5,6, and 7 are connected in series from B+ to ground. Terminal 2 of comparator 13,14,15 are connected to terminal 3 of amplifier 12. Terminal 1 of amplifier 13 and 14 are connected in between resistor 5,6, and 6,7 to generate different reference voltages. Terminal 3 of amplifier 12 is connected to terminal 2 of comparator 15. Terminal 1 of comparator 15 is connected to B+ through resistor 8, and grounded through a resistor 9. Thus, the output terminal voltage of amplifier 12 is compared with three different reference voltage made by resistor 5,6,7,8 and 9. Therefore, terminal 3 of comparator 13 becomes logic "0" when the engine temperature becomes some value greater then the predetermined maximum temperature. Similarly terminal 3 of comparator 14 and 15 becomes logic "0" as the engine reaches the predetermined minimum and maximum temperature. Terminal 3 of comparator 13,14, and 15 are connected to line 18, terminal 1 of gate 16, and terminal 2 of gate 17. Also, terminal 3 of gate 16 and 17 is connected to terminals 1 and 2 of gate 17 and 16. The inverted output of clock 19 and terminal 3 of gate 17 are connected to terminal 2 and 1 of gate 20. The output of gate 20 that is terminal 3 is connected to line 21. Therefore, voltage in line 21 becomes low before the engine starts and stays low as long as is required for the engine to reach its predetermined maximum temperature or predetermined period of time if voltage on line 21 become low because of clock 19. Thus, the system maintains ready-to-start and ready-to-drive condition. The inverted line 21, is connected to terminal 2 of gate 22, terminal 1 of gate 22 is connected to line 25, which will be discuss later. Terminal 3 of gate 22 and the inverted line 97 are connected to terminal 1 and 2 of gate 23. The output of gate 23 is connected to the gate of, transistor 24, whose drain is connected to $B^+$ while the source is connected to line 26. As a result, line 26 has a logic level "1" when the logic on line 21 is "0", or logic on line 25 is "1" that is the system is completing a sequence which has not yet been completed. On the other hand, the logic on line 26 may remain at logic "0" as long as logic on line 97 is "0". As a result line 26 is used or may be used to turn off automatically all of the components of the system which are not being used under the present condition.

Capacitor 27,28, and 29 are connected in series from the collector to the base of transistor 30. Resistor 31, and 32 are connected from the junction of capacitor 27,28 and 28,29 to line 26. The collector of transistor 30 is grounded through a resistor 33, and a resistor 34 is connected from the collector to the base. As a result this circuit became a phase-shift oscillator and capacitors 27,28,29 and resistor 31,32 make up the phase-shift network. Resistor 36 is connected from the collector of transistor 30 to terminal 2 of amplifier 35. Terminal 2 and 3 of amplifier 35 is connected through resistor 37. In addition, terminal 3 is connected to terminal 1 of a three terminal step up auto-transformer 38. Terminal 2 of transformer 38 is grounded, and terminal 3 is connected to terminal 1 of motion sensor 39. Terminal 2 of motion sensor 39 is connected to get of transistor 40. Thus, amplifier 35 is driving transformer 38 in accordance with the voltage swing in the collector of transistor 30. The high voltage swings in terminal 3 of this transformer 38 passes through terminal 2 of the motion sensor 39 according to the change of motion sensed by the motion sensor. The motion sensor is built from an object made of metal, and is hanging at the center of a hollow cylinder by a light spring. As the automobile changes its motion, this causes the metal object to swing. This swing causes the capacitance between the hanging metal object and the cylinder to change, which in turn causes the impedance to change. This change of impedance is measured by transistor 40 whose source is grounded, and drain is connected to line 26 through resistor 41, also drain is connected to terminal 2 of amplifier 43 through resistor 42. Terminal 2 and 3 of amplifier 43 are connected through resistor 44, and terminal 1 is grounded. Terminal 3 of amplifier 43 is connected to line 48 through diode 45, and line 48 is grounded through resistor 46 and capacitor 47. Therefore, amplifier 43 senses the variation of drain voltage of transistor 40. The output of terminal 3, amplifier 43, is rectified through a a diode 45, and filtered out by resistor 46 and capacitor 47. So any change in motion causes the voltage in line 48 to go high. The use of line 48 will be discussed later.

Figure 2:
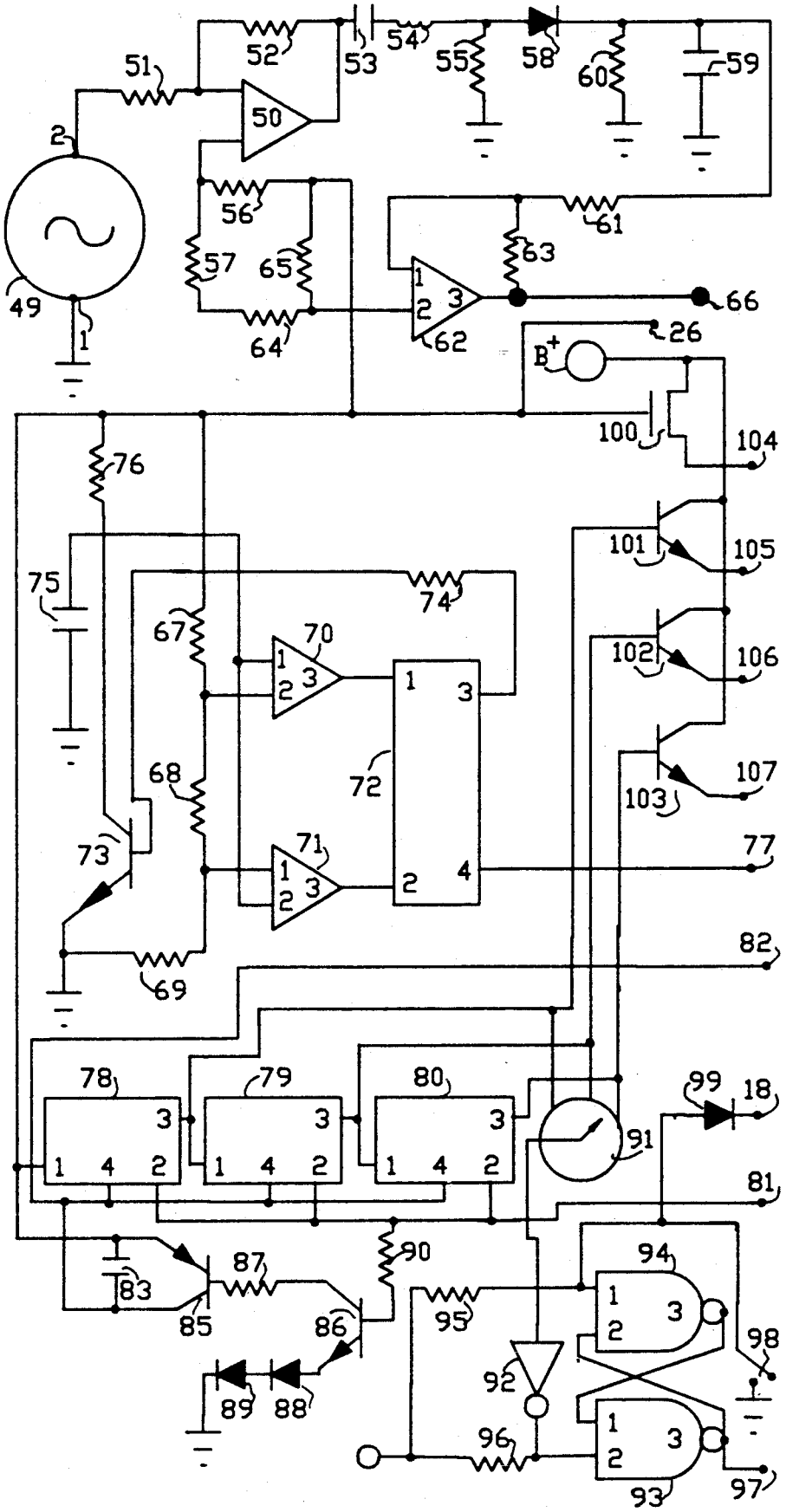
FIG. 2, is a schematic diagram for to determine engine starting condition, square wave generator, and to keep record of starting sequence.

According to FIG. 2, a microphone 49 is used to sense engine vibration or sound. Terminal 1 of microphone 49 is grounded, and terminal 2 of this microphone is connected to terminal 1 of amplifier 50 through a resistor 51. Terminal 1 and 3 of amplifier 50 is connected through resistor 52, also terminal 3 is grounded through capacitor 53, inductor 54 and resistor 55 are in series to form a RLC tuned filter (To have a high gain for particular range of frequency). Terminal 2 of amplifier 50 is connected at the junction of resistors 56 and 57, where resistor 56 and 57 are connected in series from line 26 to ground. The output of this tuned filter (Which is the junction of inductor 54 and resistor 55) is grounded through diode 58, capacitor 59 and resistor 60, where diode 58 is in series with capacitor 59 and resistor 60 is in parallel. Resistor 61 is connected from the junction of diode 58 and resistor 60 to terminal 1 of amplifier 62. Also, terminal 1 is connected to the terminal 3 of the same amplifier through resistor 63. Terminal 2 of the amplifier 62 is connected to the junction of resistor 65 and 64. Resistor 65 and 64 are connected in series from line 26 to ground. Thus, amplifier 50 amplified the input signal from the microphone. The RLC Tuned filter gives high gain response for a desired frequency that is if the engine has started, the engine noise will match with the filter resonance frequency to maximize the out put response which is later on rectified and passed through another RC filter which gives positive DC voltage for high gain response of the RLC filter. This corresponds to the engine starting condition. The purpose of the amplifier 62 is to amplify this response to generate logical levels "1" or "0" as a response on line 66 to either the condition of the engine starting or not starting.

In this section resistor 67,68, and 69 are connected in series from line 26 to ground. Junction of resistor 67,68 and 68,69 are connected to the terminal 2 and 1 of comparator 70 and 71 respectively. Terminal 3 of comparator 70, and 71 are connected to flip-flop 72 terminal 1 and 2 respectively. Terminal 3 of flip-flop 72 is connected to the base of transistor 73 through resistor 74. Emitter of transistor 73 is grounded and the collector is connected to terminal 1 and 2 of comparator 70 and 71. Collector of transistor 73 is grounded by capacitor 75 and connected to line 26 through resistor 76. Terminal 4 of flip-flop 72 is connected to the line 77. Thus, when the collector voltage is slightly less than the junction voltage, set by resistor 68 and 69, comparator 71 has a high output and resets the flip-flop. This cuts off the transistor 73, allowing the capacitor 75 to charge. When the collector voltage is slightly greater than the voltage set by the junction of resistor 67 and 68, comparator 70 has a high output, which sets the flip-flop. As soon as voltage at terminal 3 of flip-flop 72 goes high, it turns on the transistor and causes capacitor 75 to discharge and repeat the sequence by itself, as a result terminal 4 of flip-flop 72 has a square wave output, which is clock input for the digital circuits, and will be discussed soon.

Three flip-flops 78,79 and 80 are connected in series to form a 3 bit shift register, terminal 1 of flip-flop 78 is connected to line 26 and terminal 3 is connected to terminal 1 of flip-flop 79. Similarly terminal 3 of flip-flop 79 is connected to terminal 1 of flip-flop 80. Terminal 2 of flip-flop 78,79 and 80 are connected to line 81. Also terminal 4 of flip-flop 78,79 and 80 are connected to line 82. Line 82 also connected at the junction of capacitor 83 and resistor 84, where capacitor 83 and resistor 84 are connected in series from line 26 to ground. Emitter of transistor 85 is connected to line 26, and collector is connected to line 82. Base of transistor 85 is connected to the collector of transistor 86 through resistor 87. Emitter of transistor 86 is grounded through diode 88 and 89, and base is connected to line 81 through resistor 90. To describe the function, assume logic level on line 81 goes high to low and back to high corresponding to one complete starting sequence (successful or not successful sequence). Logic on line 81 is "1" if engine is in not starting condition, detail will discuss later. Thus, before the engine start terminal 1 of flip-flop 78 goes high and flip-flop 78,79 and 80 keeps record of the number of starting sequence by the use of line 81. When line 81 is high, causes transistor 86 to conduct which causes transistor 85 to conduct; therefore, transistor 85 discharge capacitor 83. Therefore, logic on line 82 remain high, if engine moved to any other state besides not starting condition, logic on line 82 still remain in logic high for particular period of time, mostly set by the capacitor 83 and resistor 84. If engine has started by this time, line 81 will remain logic "0" which will eventually cause the voltage on line 82 to drop, which will clear flip-flop 78,79 and 80 for the further use of this flip-flops. The purpose of diode 88 and 89 is to give perfect turn off situation for transistor 86. Later on, the further uses of line 82 will be discussed. The output terminal 3 of flip-flop 78,79 and 80 are connected to a regulator 91. The output of regulator 91 is connected to terminal 2 of gate 93 through a inverter 92. Terminal 2 and 3 also terminal 3 and 2 of gate 94 and 93 are connected to form a latch. Terminal 1 and 2 of gate 94 and 93 are connected to B+ through resistor 95 and 96. Terminal 3 of gate 93 is connected to line 97. Terminal 1 of gate 94 is connected to switch 98, also terminal 1 is connected to line 18 through diode 99. Thus, it is possible to regulate regulator 91 to response or have logic high output after a selected number of trials to start the engine. This logic will force logic on line 97 to high, and remain high which means to prevent further trial to start the engine. There are two different ways to clear this status. (1) By manually turning the switch 98 on and off. (2) Line 18 to clear it automatically. In addition, what has been discussed previously about line 18, when the engine temperature reach more than predetermined maximum temperature, which is assumed that the engine is ready to enable the "Cold Start" again. The purpose of doing this is to make the system totally maintenance free. Line 26 and terminal 3 of flip-flop 78,79 and 80 are connected to the gate and base of transistor 100,101,102 and 103, also drain and collector of this transistor are connected to B+, also source and emitter of this transistor are connected to line 104,105,106 and 107. Transistor 100 turns on before the engine start. If engine fails to start in first trial, transistor 101 turns on before the next trial, so do transistor 102 and 103. The purpose of this line 104,105,106 and 107 from the "Cold Start" is to alarm before it makes an attempt to start the engine. Therefore, this line can be used to make necessary adjustment of the engine before "Cold Start" attempt to start the engine.

Figure 3:
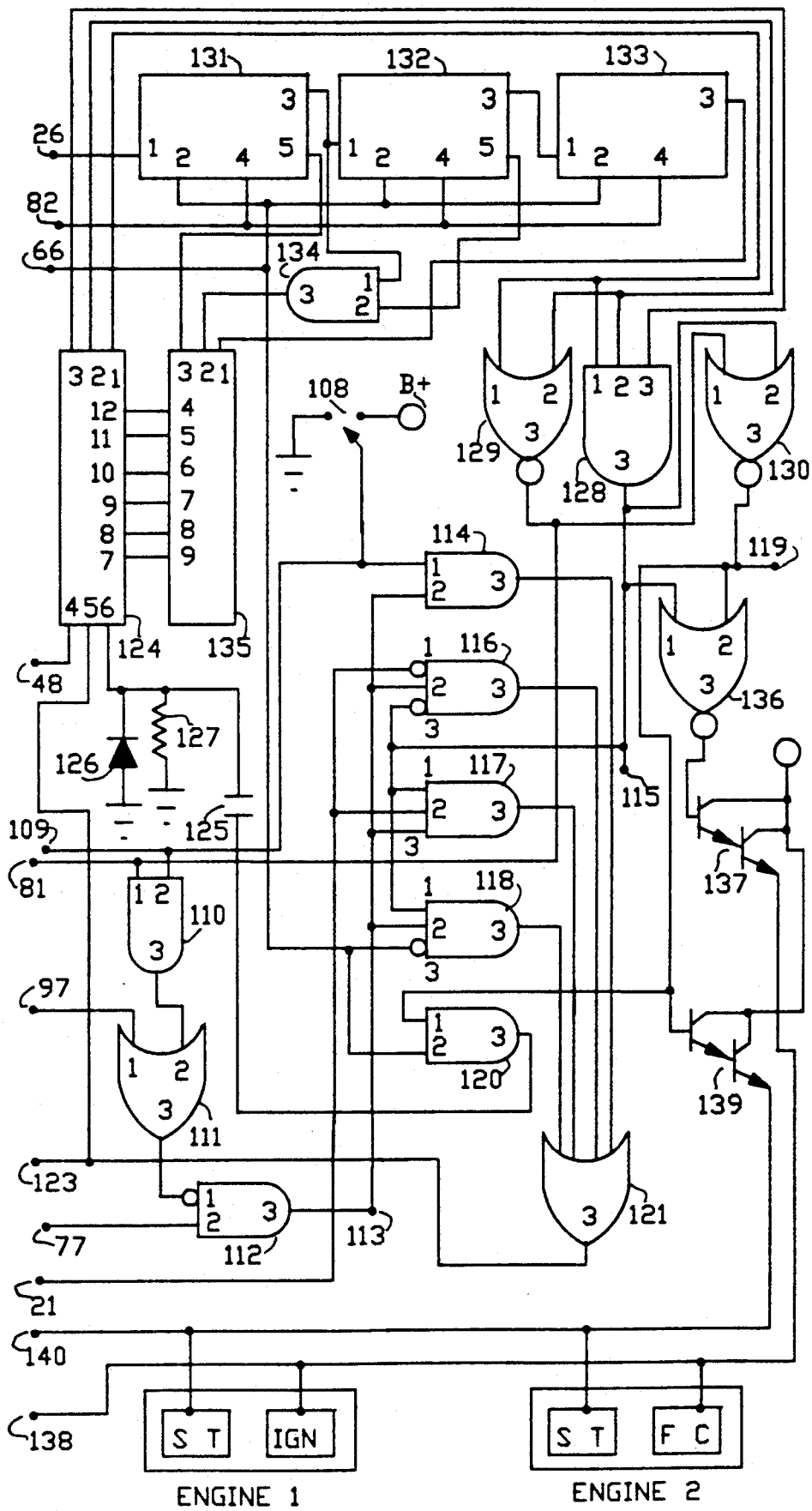
FIG. 3, is a schematic diagram for to process all of the incoming signals to turn the engine on or off.

According to FIG. 3 all of the incoming signals have been processed to turn the engine on or off or to crank as required. Switch 108 is used to turn the engine off and on by changing the logic on line 109 "1" and "0". Line 81 and 109 are connected to terminals 1 and 2 of gate 110. Terminal 3 of gate 110 and 97 are connected to terminal 2 and 1 of gate 111. The inverted output of terminal 3 of gate 111 and line 77 is connected to terminal 1 and 2 of gate 112. Thus, terminal 3 of gate 112 has the same clock pulse as in line 77. If the logic on line 109 is "0" that is if switch 108 is on, or if the logic on line 81 is "0", while logic on line 97 is "0". Terminal 3 of gate 112 is line 113. Line 109 and line 113 are connected to terminals 1 and 2 of gate 114. Inverted line 21,115 are connected to the terminals 1 and 3; in addition, line 113 is connected to terminal 2 of gate 116. Lines 115,21,113 are connected to terminal 1,2,3 of gate 117. Line 115,113 and inverted line 66 are connected to terminals 1,2,3 of gate 118. Line 119 and line 66 are connected to terminal 1 and 2 of gate 120. Terminal 3 of gates 114,116,117 and 118 are connected to input terminal of 121. Terminal 3 of gate 120 and 121 are line 122 and 123. Line 122 is connected to terminal 6 of Binary counter 124 through capacitor 125, also terminal 6 is grounded through a diode 126 and resistor 127 which are connected in parallel. Terminal 4 and 5 of counter 124 are connected to line 48 and line 123. The three most significant bits of terminals 1,2 and 3 of counter 124 are connected to terminals 1,2 and 3 of gate 128, also counter terminal 2 and 3 are connected to terminals 2 and 1 of gate 129. Terminal 3 of gate 129 and 128 are connected to terminals 1 and 2 of gate 130. The output terminal of gates 129,128 and 130 are lines 81,115 and 119. Flip-flops 131,132 and 133 are connected together to form a shift register. Terminal 1 of flip-flop 131 is connected to line 26 and terminal 3 is connected to terminal 1 of flip-flop 132. Similarly terminal 3 of flip-flop 132 is connected to terminal 1 of flip-flop 133. Terminal 4 and 2 of flip-flop 131,132,133 are connected to line 82 and line 66. Terminal 1 and 5 of flip-flop 132 are connected to terminal 1 and 2 of gate 134. Terminal 5 and 3 of flip-flop 131,133 and terminal 3 of gate 134 are connected to the address terminal 3,1 and 2 of programmable Read-only memory 135. The output of this Read-only memory, terminal 4,5,6,7,8 and 9 is connected to the data input terminals 12,11,10,9,8 and 7 of the counter 124. Lines 115 and 119 are connected to terminals 1 and 2 of gate 136, and terminal 3 of gate 136 is connected to the base of Darlington pair transistor 137. Its collector is connected to B+ and its emitter is line 138. Similarly line 119 is connected to the base of transistor pair 139. The emitter of this transistor pair 139 is line 140. To describe the function of the components of this information processing unite, the logic on line 81,115 and 119 represents the different stages of the engine starting condition. The function of line 81 has already been discussed. The logic on line 115 is high if the engine is running or assumed to be running. Similarly the logic on line 119 becomes high if the starter is engaged or assumed to be engaged to start the engine. The voltage on line 138 goes high when the logic on line 115 or 119 is high. Voltage on line 140 goes high when logic on line 119 goes high. Therefore, line 138 is used to turn on the ignition for gasoline engine or to control fuel for gas-diesel or diesel engine, and line 140 is used to engage the starter for both gasoline and gas-diesel or diesel engine.

To describe in general line 123 has clock pulses ready when it is require to move the engine from its present starting state, this clock pulses go in to terminal 5 of counter 124, as a result counter 124 start counting up from its present state or load data from the memory 135 and start counting up. Three most significant bit of this counter is decoded by gate 129,128 and 130 to give three different stage, stop, starter on and engine on. Flip-flop 131,132 and 133 keeps record of the number of trial has been made.

Taking different situation and checking the response of this components. If logic on line 21 moves from logic "1" to logic "0" which enable gate 116 to pass clock pulses through, while logic in gate 114,117 and 118 remain "0"; therefore, clock pulses pass through gate 121 to line 123 which allow the counter 124 to count up, as a result, few moment later logic "1" on line 81 moves to line 119 (Which activate the starter as mentioned earlier). It will stay there for a particular period of time before it makes automatic return, but if engine has started by this time, it would require to keep the logic "1" on line 119 for a moment for to make sure that the engine will stay on, then move logic "1" to line 115 for continuous running until logic on line 21 moves back to logic 1. To do this when engine starts logic on line 66 becomes 1 which makes logic on line 122 go from "0" to "1" as a result a sharp pulse appear at terminal 6 of counter 124, which load the counter from memory 135 addressed by flip-flop 131,132 and 133, then counter starts counting up from that address and move the "1" from line 119 to 115. If engine fails to stay on by the time addressed by the memory 135, this failure will be recorded in the shift register, as a result different time (longer than the previous addressed time ) will be addressed by the memory 135 to counter 124, when system makes next attempt to start the engine and continue trying until engine starts or reach to predetermined maximum number of trials. If engine starts and stays on which disable get 114, 116,117 and 118 and as a result it hold the counter to count up. If some other reason engine stops running, but has not completed the desire condition, as a result logic on line 66 will be "0" which enable get 118; therefore, logic on line 115 moved back to line 81 and try to restart the engine from the beginning.

If accidentally engine remains in gear (or in contract with the wheel). So when system attempt to activate the starter which will cause the automobile to move, as a result interruption will come through line 48 to clear the counter. After a number of clearing sequence, set by number of maximum trial, system will automatically stop further trial to start the engine. This interruption also take place if the automobile being pushed by other source, while engine was running by the "Cold Start".

Figure 4:
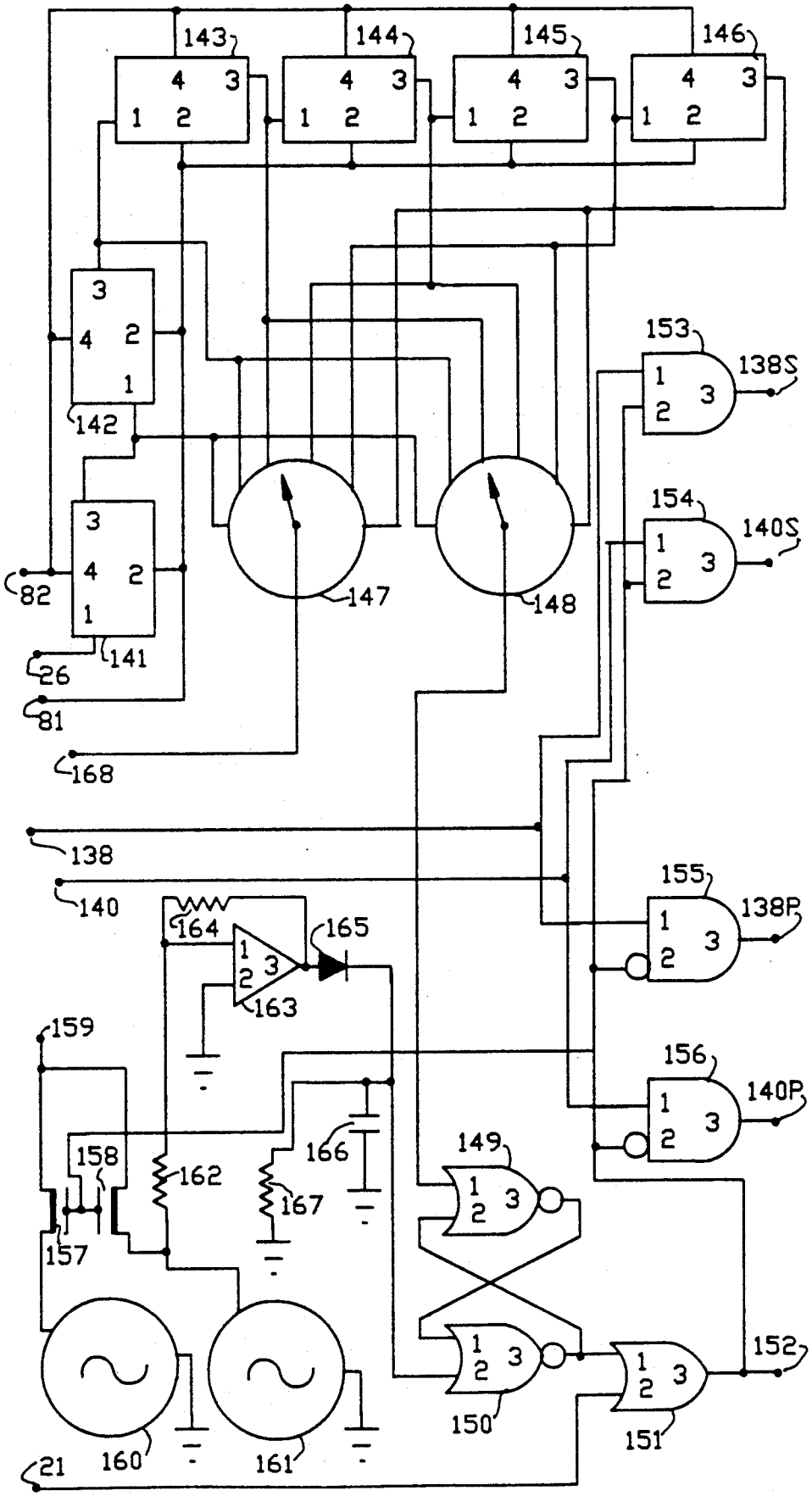
FIG. 4, is a schematic diagram for multiple engine.

Referring to FIG. 4, flip-flop 141 to 146 are connected in series to form a shift register. Terminal 1 of flip-flop 141 is connected to line 26, and terminal 3 of flip-flop 141 to 145 are connected to terminal 1 of flip-flop 142 to 146. Terminal 2 and 4 of flip-flop 141 to 146 are connected to line 81 and 82 (respectively). Terminal 3 of flip-flop 141 to 146 are connected to regulator 147 and 148. The output terminal of regulator 147 is connected to terminal 1 of gate 94 through line 168. The output of regulator 148 is connected to terminal 1 of gate 149. Terminal 2 and 3 of gate 149 are connected to terminal 3 and 1 of gate 150. Terminal 3 of gate 150 is connected to terminal 1 of gate 151. Terminal 2 and 3 of gate 151 are connected to line 21 and 152. Line 152 is used to switch the system from primary to secondary engine or vice-versa. Line 152 is connected to terminal 2 of gate 153 and 154 and inverted line 152 is connected to terminal 2 of gate 155 and 156. Terminal 1 of gate 153 and 155 are connected to line 138. In addition, line 140 is connected to terminal 1 of gate 154 and 156. Line 152 is connected to the gate of transistor 157 and 158. The source of transistor 157 and 158 are connected to line 159, and drains are connected to microphone 160 and 161. Line 159 is connected to resistor 51. The other terminals of microphones are connected to the ground. Resistor 162 is connected from the junction of transistor 158 and microphone 161 to terminal 1 of amplifier 163. Terminal 1 and 3 of amplifier 163 are connected through resistor 164, terminal 2 is grounded. Terminal 3 of amplifier 163 is connected to terminal 2 of gate 150 through diode 165. In addition, terminal 2 of gate 150 is grounded through capacitor 166 and resistor 167 in parallel. Therefore, flip-flop 141 to 146 keeps a record of the number of trials that are being made to start the primary and secondary engine. Note, the output terminal 3 of gate 153 and 154 are line 138S and 140S are for secondary engine, similarly line 138P and 140P are for primary engine.

The system first try to start the primary engine in said manner, if it fails to start by the predetermined maximum number of trial set by the regulator 148. The logic on line 142 become "1", which disable the system and its sensors for primary engine, and enable the system for secondary engine and its sensors or vice-versa. The reason for doing this, so that when primary engine is too hot or some external reason it is require to start secondary engine, system can switch back-and-forth between primary and secondary engine. Same as primary engine system will try to start the secondary engine in the said manner if it fails to start the secondary engine by the predetermined number of trial set by the regulator 147, the system will stop further trial to start either engine by bringing the logic on line 97 to "0" through line 168. The system will enable itself by the microphone 160 or 161 and amplifier 163, if it sense any motion of either engine (according to this figure it is shown only for primary engine for the simplicity of the circuit). If primary engine fails to start, therefore, system is running the secondary engine, the system can turn off the secondary engine and continue running the primary engine if it sense the running condition of the primary engine. Thus, the multiple engine control system become totally maintenance free. Note, the use of line 138S, 140S, and 138P, 140P are same as line 138 and 140. Subscript S and P for secondary and primary engine.

We claim:

1. Apparatus for maintaining at least one gas or diesel engine at a ready-to-start temperature under ready-to-drive conditions corresponding to a set of predefined engine parameters, the engine including starter means and fuel supply means, said apparatus comprising, means for sensing engine temperature and generating a corresponding first electrical signal indicative of the instantaneous temperature of said engine, means for sensing engine vibration or sound and generating a corresponding second electrical signal indicative of whether or not said engine is running, means for sensing engine motion and generating a corresponding third electrical signal indicative of movement of said engine from a stationary position, and control means for regulating the starting and stopping of said engine, said control means including means responsive to said first electrical signal for starting said engine, by activating said starter and fuel supply means, when the engine temperature drops below a predetermined temperature value, and for deactivating said fuel supply means to thereby stop said engine when the engine temperature moves above a predetermined temperature value, means for controlling said means for starting for providing a predetermined maximum number of successive attempts to start said engine if prior attempts to start said engine have failed, means responsive to said second electrical signal for changing predefined engine parameters including the activation time of said starter means, for each attempt to start said engine, means responsive to said third electrical signal for disabling said fuel supply means to stop said engine if a predetermined amount of motion is detected.

2. The apparatus of claim 1 wherein said control means includes memory means for storing predefined engine parameters, including the maximum and minimum temperature values, and the maximum and current number of attempts at starting said engine.

3. The device according to claim 1 a clock is by passing the temperature logic to maintain the ready-to-drive condition while maintaining ready-to-start condition.

4. The device according to claim 1 includes a microphone that sense the engine sound and send the information to the circuit to determine the engine starting condition.

5. Device according to claim 1 also includes a built-in-motion sensor which does not require any mechanical or electrical signal going into the device, but it can stop the engine immediately when it senses any accidental motion of the vehicle.

6. Device according to claim 1 has a system to keep record of the number of trials has been made to start the engine and other internal records, based on those records, circuit decides the required cranking time.

7. According to claim 1 this system will be disabled by itself if all those trials fail to start the engine, and it enables itself when the engine runs again.

8. The apparatus of claim 1 wherein said temperature sensing means is a diode-based temperature sensor.

9. The apparatus according to claim 1 wherein said control means is adapted to control, in combination, the starting and stopping of a primary engine and a secondary engine in such a way as to ensure that at least one of said engines is kept running, said apparatus including means for sensing temperature, vibration or sound, and motion for each engine, wherein said control means includes means for starting said secondary engine if said primary engine fails to start after the predetermined maximum number of start attempts or if the predefined maximum temperature value has been reached for said primary engine, and means responsive to the primary engine temperature dropping below said minimum temperature value for stopping said secondary engine and restarting said primary engine.

10. The apparatus of claim 9 wherein said means for starting said secondary engine is also responsive to said means for providing a predetermined maximum number of start attempts and to said means for changing predefined engine parameters for each start attempt.

11. Device according to claim 1 uses feedback from primary and secondary engines where engine sound is being analyzed to determine engine starting condition.

* * * * *